United States Patent [19]

Beck et al.

[11] Patent Number: 4,513,093

[45] Date of Patent: Apr. 23, 1985

[54] IMMOBILIZATION OF VANADIA DEPOSITED ON SORBENT MATERIALS DURING TREATMENT OF CARBO-METALLIC OILS

[75] Inventors: H. Wayne Beck, Russell; James D. Carruthers, Catlettsburg; Edward B. Cornelius, Ashland; William P. Hettinger, Jr., Russell; Stephen M. Kovach, Ashland; James L. Palmer, Flatwoods; Oliver J. Zandona, Ashland, all of Ky.

[73] Assignee: Ashland Oil, Inc., Ashland, Ky.

[21] Appl. No.: 277,752

[22] PCT Filed: Mar. 19, 1981

[86] PCT No.: PCT/US81/00357

§ 371 Date: Mar. 30, 1981

§ 102(e) Date: Mar. 30, 1981

[87] PCT Pub. No.: WO82/03226

PCT Pub. Date: Sep. 30, 1982

[51] Int. Cl.[3] ..... B01J 21/16

[52] U.S. Cl. ..... 502/84; 502/521

[58] Field of Search ..... 252/455 R, 448, 454; 562/84, 521

[56] References Cited

U.S. PATENT DOCUMENTS

| | | | |
|---|---|---|---|
| 2,258,787 | 10/1941 | Melaven et al. | 208/119 |
| 2,308,557 | 1/1943 | Watson | 208/74 |
| 2,344,911 | 3/1944 | Young | 208/119 |
| 2,374,313 | 4/1945 | Veltman | 208/120 |
| 2,454,942 | 11/1948 | Pierce et al. | 252/448 |
| 2,471,131 | 5/1949 | Viles | 208/113 |
| 2,579,123 | 12/1951 | Pardee | 208/52 CT |
| 2,862,878 | 12/1958 | Morrell | 252/454 X |
| 2,886,513 | 5/1959 | Baker | 208/121 |
| 2,901,419 | 8/1959 | Brill | 208/119 |
| 3,471,410 | 10/1969 | Oleck et al. | 252/455 Z |
| 3,546,094 | 12/1970 | Jaffe | 208/59 |
| 3,696,025 | 10/1972 | Chessmore et al. | 208/113 |
| 3,746,659 | 7/1973 | Horzepa | 252/455 R |
| 3,977,963 | 8/1976 | Readal et al. | 208/120 |
| 4,101,417 | 7/1978 | Mitchell et al. | 208/120 |
| 4,111,845 | 9/1978 | McKay | 252/455 Z |
| 4,141,858 | 2/1979 | McKay | 252/439 |
| 4,208,302 | 6/1980 | McKay | 252/411 R |
| 4,244,810 | 1/1981 | Youngblood et al. | 208/120 |
| 4,256,564 | 3/1981 | Roberts et al. | 208/120 |
| 4,264,433 | 4/1981 | McKay | 208/113 |
| 4,264,434 | 4/1981 | Bertus et al. | 208/120 |
| 4,268,376 | 5/1981 | Foster | 208/126 |
| 4,283,274 | 8/1981 | McKay et al. | 208/120 |
| 4,331,533 | 5/1982 | Dean et al. | 208/113 |
| 4,332,674 | 6/1982 | Dean et al. | 208/120 |
| 4,336,160 | 6/1982 | Dean et al. | 252/417 |
| 4,428,826 | 1/1984 | Walsh | 208/120 |

*Primary Examiner*—Carl F. Dees

*Attorney, Agent, or Firm*—Richard C. Willson, Jr.

[57] ABSTRACT

A process is disclosed for the treatment of a hydrocarbon oil feed having a significant content of vanadium to provide a higher grade of oil products by contacting the feed under treatment conditions in a treatment zone with sorbent material containing a metal additive to immobilize vanadium compounds. Treatment conditions are such that coke and vanadium are deposited on the sorbent in the treatment zone. Coked sorbent is regenerated in the presence of an oxygen containing gas at a temperature sufficient to remove the coke, and regenerated sorbent is recycled to the treatment zone for contact with fresh feed. The metal additive is present on the sorbent in an amount sufficient to immobilize the vanadium compounds in the presence of oxygen containing gas at the sorbent regeneration temperature. A sorbent composition disclosed comprises a kaolin clay containing the metal additive, which may be introduced into the clay during the treatment process or during sorbent manufacture. Metal additives include water soluble inorganic metal salts and hydrocarbon soluble organo-metallic compounds of select metals.

29 Claims, 6 Drawing Figures

FIG. 5

SORBENT ADDITION RATES REQUIRED TO HOLD VANADIUM AT GIVEN LEVEL ON SORBENT FOR FEEDS WITH VARYING LEVELS OF VANADIUM CONTENT.

40,000 BBL./DAY UNIT

| TOTAL VANADIUM PPM | #METAL / DAY | LEVEL ON EQUILIBRIUM MATERIAL PPM WT. | | | |
|---|---|---|---|---|---|
| | | 5000 | 10,000 | 20,000 | 30,000 |
| | | 0.5% | 1.0% | 2.0% | 3.0% |
| | | DAILY TONNAGE REPLACEMENT | | | |
| 400 | 5200 | 500 | 250 | 125 | 82 |
| 200 | 2600 | 250 | 125 | 65 | 42 |
| 100 | 1300 | 125 | 63 | 32 | 21 |
| 50 | 650 | 63 | 32 | 16 | 10 |
| 25 | 325 | 32 | 16 | 8 | 5 |

FIG. 6

FEED - 40,000 Bbl/DAY; 1 BBL = 335 Lbs.; Ti ADDITIVE = $12/lb. OF TITANIA CONTENT IN TPT
= $1.50/bl. OF TITANIA CONTENT IN $TiCl_4$

| METALS IN FEED, ppm | lb. V/bbl. | lb. V/DAY | lb. Ti/bbl. | lb. Ti/DAY | Ti COST ¢/bbl. TPT | Ti COST ¢/bbl. $TiCl_4$ | 10,000 ppm SORBENT ADD'n $/DAY(1) | 30,000 ppm SORBENT ADD'n $/DAY(2) | SAVINGS $1/DAY(3) TPT | SAVINGS $1/DAY(3) $TiCl_4$ |
|---|---|---|---|---|---|---|---|---|---|---|
| 1 | $3.35 \times 10^{-4}$ | 13 | $3.35 \times 10^{-4}$ | 13 | 0.4 | 1.04 | 577 | 188 | 28 | 168 |
| 25 | $8.4 \times 10^{-3}$ | 325 | $8.4 \times 10^{-3}$ | 325 | 10 | 1.25 | 14,400 | 4,500 | 500 | 4,000 |
| 50 | $1.7 \times 10^{-2}$ | 650 | $1.7 \times 10^{-2}$ | 650 | 20 | 2.5 | 28,800 | 9,000 | 1,000 | 8,000 |
| 100 | $3.4 \times 10^{-2}$ | 1,300 | $3.4 \times 10^{-2}$ | 1,300 | 40 | 5 | 56,700 | 18,000 | 2,000 | 22,400 |

(1) (2) SEE FIGURE 5, TO OBTAIN SORBENT ADDITION RATE TO MAINTAIN SORBENT AT 10,000 ppm LEVEL AND 30,000 ppm LEVEL. SORBENT COST = 45¢/lb.

(3) SORBENT COST SAVINGS BASED ON DIFFERENCE BETWEEN Ti COST (TPT) OR ($TiCl_4$) AND DIFFERENCE IN SORBENT RATE COST, (1) MINUS (2)

IMMOBILIZATION OF VANADIA DEPOSITED ON SORBENT MATERIALS DURING TREATMENT OF CARBO-METALLIC OILS

TECHNICAL FIELD

This invention relates to producing a high grade of oil feed having lowered metals and Conradson carbon values for use as feedstocks for reduced crude conversion processes and/or for typical FCC processes from a poor grade of carbo-metallic oil having extremely high metals and Conradson carbon values. More particularly, this invention is related to a sorbent material containing a metal additive to immobilize vanadium compounds deposited on the sorbent during pretreatment of the oil feed. The metal additive for vanadium immobilization may be added during sorbent manufacture, after manufacture by impregnation of the virgin sorbent, or at any point in the sorbent cycle for treatment of the oil feed.

BACKGROUND OF THE INVENTION

The introduction of catalytic cracking to the petroleum industry in the 1930's constituted a major advance over previous techniques with the object of increasing the yield of gasoline and its quality. Early fixed bed, moving bed, and fluid bed catalytic cracking FCC processes employed vacuum gas oils (VGO) from crude sources that were considered sweet and light. The terminology of sweet refers to low sulfur content and light refers to the amount of material boiling below approximately 1,000°-1,025° F.

The catalysts employed in early homogeneous fluid dense beds were of an amorphous siliceous material, prepared synthetically or from naturally occurring materials activated by acid leaching. Tremendous strides were made in the 1950's in FCC technology in the areas of metallurgy, processing equipment, regeneration and new more-active and more stable amorphous catalysts. However, increasing demand with respect to quantity of gasoline and increased octane number requirements to satisfy the new high horsepower-high compression engines being promoted by the auto industry, put extreme pressure on the petroleum industry to increase FCC capacity and severity of operation.

A major breakthrough in FCC catalysts came in the early 1960's with the introduction of molecular sieves or zeolites. These materials were incorporated into the matrix of amorphous and/or amorphous/kaolin materials constituting the FCC catalysts of that time. These new zeolitic catalysts, containing a crystalline aluminosilicate zeolite in an amorphous or amorphous/kaolin matrix of silica, alumina, silica-alumina, kaolin, clay or the like, were at least 1,000-10,000 times more active for cracking hydrocarbons than the earlier amorphous or amorphous/kaolin containing silica-alumina catalysts. This introduction of zeolitic cracking catalysts revolutionized the fluid catalytic cracking process. New innovations were developed to handle these high activities, such as riser cracking, shortened contact times, new regeneration processes, new improved zeolitic catalyst developments, and the like.

The new catalyst developments revolved around the development of various zeolites such as synthetic types X and Y and naturally occurring faujasites; increased thermal-steam (hydrothermal) stability of zeolites through the inclusion of rare earth ions or ammonium ions via ion-exchange techniques; and the development of more attrition resistant matrices for supporting the zeolites.

These zeolitic catalyst developments gave the petroleum industry the capability of greatly increasing throughput of feedstock with increased conversion and selectivity while employing the same units without expansion and without requiring new unit construction.

After the introduction of zeolite containing catalysts, the petroleum industry began to suffer from a lack of crude availability as to quantity and quality accompanied by increasing demand for gasoline with increasing octane values. The world crude supply picture changed dramatically in the late 1960's and early 1970's. From a surplus of light, sweet crudes the supply situation changed to a tighter supply with an ever increasing amount of heavier crudes with higher sulfur contents. These heavier and higher sulfur crudes presented processing problems to the petroleum refiner in that these heavier crudes invariably also contained much higher metals and Conradson carbon values, with accompanying significantlyincreased asphaltic content.

Fractionation of the total crude to yield cat cracker charge stocks also required much better control to ensure that metals and Conradson carbon values were not carried overhead to contaminate the FCC charge stock. The effects of heavy metal and Conradson carbon on a zeolite containing FCC catalyst have been described in the literature as to their highly unfavorable effect in lowering catalyst activity and selectivity for gasoline production and their equally harmful effect on catalyst life.

As mentioned previously, these heavier crude oils also contained more of the heavier fractions and yielded less or lower volume of the high quality FCC charge stocks which normally boil below about 1,025° F. and are usually processed so as to contain total metal levels below 1 ppm, preferably below 0.1 ppm, and Conradson carbon values substantilly below 1.0.

With the increasing supply of heavier crudes, which meant lowered yields of gasoline, and the increasing demand for liquid transporation fuels, the petroleum industry began a search for processing schemes to utilize these heavier crudes in producing gasoline. Many of these processing schemes have been described in the literature. These include Gulf's Gulfining and Union Oil's Unifining processes for treating residuum, UOP's Aurabon process, Hydrocarbon Research's H-Oil process, Exxon's Flexicoking process to produce thermal gasoline and coke, H-Oil's Dynacracking and Phillip's Heavy Oil Cracking (HOC) processes. These processes utilize thermal cracking or hydrotreating followed by FCC or hydrocracking operations to handle the higher content of metal contaminants (Ni-V-Fe-Cu-Na) and high Conradson carbon values of 5-15. Some of the drawbacks of these types of processing are as follows: Coking yields thermally cracked gasoline which has a much lower octane value than cat cracked gasoline and is unstable due to the production of gum from diolefins and requires further hydrotreating and reforming to produce a high octane product; gas oil quality is degraded due to thermal reactions which produce a product containing refractory polynuclear aromatics and high Conradson carbon levels which are highly unsuitable for catalytic cracking; and hydrotreating requires expensive high pressure hydrogen, multi-reactor systems made of special alloys, costly operations, and a separate costly facility for the production of hydrogen.

To better understand the reasons why the industry has progressed along the processing schemes described, one must understand the known and established effects of contaminant metals (Ni-V-Fe-Cu-Na) and Conradson carbon on the zeolite containing cracking catalysts and the operating parameters of a FCC unit. Metal content and Conradson carbon are two very effective restraints on the operation of a FCC unit and may even impose undesirable restraints on a Reduced Crude Conversion (RCC) unit from the standpoint of obtaining maximum conversion, selectivity and life. Relatively low levels of these contaminants are highly detrimental to a FCC unit. As metals and Conradson carbon levels are increased still further, the operating capacity and efficiency of a RCC unit may be adversely affected or made uneconomical. These adverse effects occur even though there is enough hydrogen in the feed to produce an ideal gasoline consisting of only toluene and isomeric pentenes (assuming a catalyst with such ideal selectivity could be devised).

The effect of increased Conradson carbon is to increase that portion of the feedstock converted to coke deposited on the catalyst. In typical VGO operations employing a zeolite containing catalyst in a FCC unit, the amount of coke deposited on the catalyst averages about 4–5 wt % of the feed. This coke production has been attributed to four different coking mechanisms, namely, contaminant coke from adverse reactions caused by metal deposits, catalytic coke caused by acid site cracking, entrained hydrocarbons resulting from pore structure adsorption and/or poor stripping, and Conradson carbon resulting from pyrolytic distillation of hydrocarbons in the conversion zone. There has been postulated two other sources of coke present in reduced crudes in addition to the four present in VGO. They are: (1) adsorbed and absorbed high boiling hydrocarbons which do not vaporize and cannot be removed by normally efficient stripping, and (2) high molecular weight nitrogen containing hydrocarbon compounds adsorbed on the catalyst's acid sites. Both of these two new types of coke producing phenomena add greatly to the complexity of resid processing. Therefore, in the processing of higher boiling fractions, e.g., reduced crudes, residual fractions, topped crude, and the like, the coke production based on feed is the summation of the four types present in VGO processing (the Conradson carbon value generally being much higher than for VGO), plus coke from the higher boiling unstrippable hydrocarbons and coke associated with the high boiling nitrogen containing molecules which are adsorbed on the catalyst. Coke production on clean catalyst, when processing reduced crudes, may be estimated as approximately 4 wt % of the feed plus the Conradson carbon value of the heavy feedstock.

The coked catalyst is brought back to equilibrium activity by burning off the deactivating coke in a regeneration zone in the presence of air, and the regenerated catalyst is recycled back to the reaction zone. The heat generated during regeneration is removed by the catalyst and carried to the reaction zone for vaporization of the feed and to provide heat for the endothermic cracking reaction. The temperature in the regenerator is normally limited because of metallurgical limitations and the hydrothermal stability of the catalyst.

The hydrothermal stability of the zeolite containing catalyst is determined by the temperature and steam partial pressure at which the zeolite begins to rapidly lose its crystalline structure to yield a low activity amorphous material. The presence of steam is highly critical and is generated by the burning of adsorbed and absorbed (sorbed) carbonaceous material which has a significant hydrogen content (hydrogen to carbon atomic ratios generally greater than about 0.5). This carbonaceous material is principally the high boiling sorbed hydrocarbons with boiling points as high as 1500°–1700° F. or above that have a modest hydrogen content and the high boiling nitrogen containing hydrocarbons, as well as related porphyrins and asphaltenes. The high molecular weight nitrogen compounds usually boil above 1,025° F. and may be either basic or acidic in nature. The basic nitrogen compounds may neutralize acid sites while those that are more acidic may be attracted to metal sites on the catalyst. The porphyrins and asphaltenes also generally boil above 1,025° F. and may contain elements other than carbon and hydrogen. As used in this specification, the term "heavy hydrocarbons" includes all carbon and hydrogen containing compounds that do not boil below about 1,025° F., regardless of whether other elements are also present in the compound.

The heavy metals in the feed are generally present as porphyrins and/or asphaltenes. However, certain of these metals, particularly iron and copper, may be present as the free metal or as inorganic compounds resulting from either corrosion of process equipment or contaminants from other refining processes.

As the Conradson carbon value of the feedstock increases, coke production increases and this increased load will raise the regeneration temperature; thus the unit may be limited as to the amount of feed that can be processed because of its Conradson carbon content. Earlier VGO units operated with the regenerator at 1,150°–1,250° F. A new development in reduced crude processing, namely, Ashland Oil's "Reduced Crude Conversion Process", as described in the pending U.S. applications referenced below, can operate at regenerator temperatures in the range of 1,350°–1,400° F. But even these higher regenerator temperatures place a limit on the Conradson carbon value of the feed at approximately 8, which represents about 12–13 wt % coke on the catalyst based on the weight of feed. This level is controlling unless considerable water is introduced to further control temperature, which addition is also practiced in Ashland's RCC processes.

The metal containing fractions of reduced crudes contain Ni-V-Fe-Cu in the form of porphyrins and asphaltenes. These metal containing hydrocarbons are deposited on the catalyst during processing and are cracked in the riser to deposit the metal or are carried over by the coked catalyst as the metallo-porphyrin or asphaltene and converted to the metal oxide during regeneration. The adverse effects of these metals as taught in the literature are to cause nonselective or degradative cracking and dehydrogenation to produce increased amounts of coke and light gases such as hydrogen, methane and ethane. These mechanisms adversely affect selectivity, resulting in poor yields and quality of gasoline and light cycle oil. The increased production of light gases, while impairing the yield and selectivity of the processes, also puts an increased demand on the gas compressor capacity. The increase in coke production, in addition to its negative impact on yield, also adversely affects catalyst activity-selectivity, greatly increases regenerator air demand and compressor capacity, and may result in uncontrollable and/or dangerous regenerator temperatures.

These problems of the prior art have been greatly minimized by the development at Ashland Oil, Inc. of its Reduced Crude Conversion (RCC) Processes described in Ser. No. 094,092 and the other co-pending applications referenced below and incorporated herein by reference. The new process can handle reduced crudes or crude oils containing high metals and Conradson carbon values previously not susceptible to direct processing. Normally, these crudes require expensive vacuum distillation to isolate suitable feedstocks and produce as a by-product, high sulfur containing vacuum still bottoms. Ashland's RCC process avoids all of these prior art disadvantages. However, certain crudes such as Mexican Mayan or Venezuelan contain abnormally high metal and Conradson carbon values. If these poor grades of crude are processed in a reduced crude process, they will lead to an uneconomical operation because of the high load on the regenerator and the high catalyst addition rate required to maintain catalyst activity and selectivity. The addition rate can be as high as 4–8 lbs/bbl which at today's catalyst prices, can add as much as $2–8/bbl of additional catalyst cost to the processing economics. On the other hand, it is desirable to develop an economical means of processing poor grade crude oils, such as the Mexican Mayan, because of their availability and cheapness as compared to Middle East crudes.

The literature suggests many processes for the reduction of metals content and Conradson carbon values of reduced crudes and other contaminated oil fractions. One such process is that described in U.S. Pat. No. 4,243,514 and German Pat. No. 29 04 230 assigned to Engelhard Minerals and Chemicals, Inc., which patents are incorporated herein by reference. Basically, these prior art processes involve contacting a reduced crude fraction or other contaminated oil with sorbent at elevated temperature in a sorbing zone, such as a fluid bed, to produce a product of reduced metal and Conradson carbon value. One of the sorbents described in U.S. Pat. No. 4,243,514 is an inert solid initially composed of kaolin, which has been spray dried to yield microspherical particles having a surface area below 100 $m^2/g$ and a catalytic cracking micro-activity (MAT) value of less than 20 and subsequently calcined at high temperature so as to achieve better attrition resistance. As the vanadia content on such sorbents increases, into the range of 10,000–30,000 ppm, the sorbent begins to have fluidization problems which have been overcome previously by removal of most of the spent sorbent inventory and addition of fresh virgin material. This usually requires shutting down the sorbent contacting facility.

DISCLOSURE OF THE INVENTION

The invention provides a method of producing a high grade of reduced crude conversion (RCC) feedstocks having lowered metals and Conradson carbon values relative to a poor grade of reduced crude or other carbo-metallic oil having extremely high metals and Conradson carbon values.

The invention may further be used for processing crude oils or crude oil fractions with significant levels of metals and/or Conradson carbon to provide an improved feedstock for typical fluid catalytic (FCC) cracking processes.

Crude oils or residual fractions from the distillation of crude oils may contain substantial amounts of metals such as Ni, V, Fe, Cu, Na and have high Conradson carbon values. These oils are made suitable for processing in a reduced crude conversion (RCC) process or a fluid catalytic cracking (FCC) process by preliminarily contacting the oil with a sorbent material exhibiting relatively low or no significant catalytic cracking activity at elevated temperatures to reduce the metals and Conradson carbon values.

It has been found that as vanadium pentoxide and/or sodium vanadates build up on a sorbent, the elevated temperatures encountered in regeneration zones cause the vanadia to flow and form a liquid coating on the sorbent particles. Any interruption or decrease in particle flow may result in coalescence between the liquid coated sorbent particles. Once coalescence occurs, fluidization becomes difficult to reinitiate. This results in stoppage of flow in cyclone diplegs, ineffective operation of cyclones, rapid increases in the loss of the sorbent, and may finally result in unit shutdown.

An important feature of the invention is the inclusion of a metal additive, such as a select metal, its oxide or salt, or its organo-metallic compound into the sorbent material during or after its manufacture or during the oil processing cycle so as to immobilize sodium vanadates, and/or vanadium pentoxide deposited on the sorbent during processing of the oil for metals and/or Conradson carbon removal.

The invention thus provides an improved sorbent and an improved method for treatment of petroleum oil feeds containing significant levels of vanadium (at least about 1.0 ppm). More particularly, metal additives are provided on the sorbent to reduce particle coalescence and loss of fluidization caused by the vanadium contaminants in oil feeds of all types utilized in FCC and/or RCC operations. The invention is particularly useful in the pretreatment of carbo-metallic oil feeds to be utilized in RCC units.

Some crude oils and some FCC charge stocks from the distillation of crude oils contain significant amounts (greater than 1.0 ppm) of heavy metals such as Ni, V, Fe, Cu, Na. Residual fractions from crude oil distillation have even greater amounts of heavy metals and may also have high Conradson carbon values. As used throughout the specification, "vanadia" refers collectively to the oxides of vanadium. It has been found that as the vanadium oxide level builds up on the catalyst, the elevated temperatures encountered in the catalyst regeneration zone cause vanadium pentoxide ($V_2O_5$) to melt and this liquid vanadia to flow. This melting and flowing of vanadia can, particularly at high vanadia levels and for sorbent materials with low surface area, also coat the outside of sorbent microspheres with liquid and therby cause coalescence between sorbent particles which adversely affects its fluidization properties. According to the present invention, the adverse effects of vanadium are greatly reduced by contacting contaminated oil feeds with a sorbent containing a metal additive to immobilize vanadium oxides deposited on the sorbent during feed pretreatment. The select metal additives of this invention were chosen so as to form compounds or complexes with vanadia which have melting points above the temperatures encountered in sorbent regeneration zones, thus avoiding particle fusion.

The method of addition of the metal additive can be during sorbent manufacture or at any point in the reduced crude pretreating cycle. Addition during manufacture may be either to the sorbent slurry before particle formation or by impregnation after the sorbent slurry has been formed into particles, such as spray dried microspheres. It is to be understood that the sorbent particles can be of any size, depending on the size appropriate to the conversion process in which the sorbent is to be employed. Thus, while a fluidizable size is preferred, the metal additives may be employed with larger particles, such as those for moving beds in contact with unvaporized feeds.

The problems of the prior art caused by vanadium containing contaminants are overcome by employing the sorbent and select metal additive of this invention. This invention is especially effective in the treatment of reduced crudes and other carbo-metallic feeds with high metals, high vanadium to nickel ratios and high Conradson carbon values. This RCC feed having high metal and Conradson carbon values is preferably contacted in a riser with an inert solid sorbent of low surface area at temperatures above about 900° F. Residence time of the oil in the riser is below 5 seconds, preferably 0.5–2 seconds. The preferred sorbent is a spray dried composition in the form of microspherical particles generally in the size range of 10 to 200 microns, preferably 20 to 150 microns and more preferably between 40 and 80 microns, to ensure adequate fluidization properties.

The RCC feed is introduced at the bottom of the riser and contacts the sorbent at a temperature of 1,150°–1,400° F. to yield a temperature at the exit of the riser in the sorbent disengagement vessel of approximately 900°–1,100° F. Along with the RCC feed, water, steam, naphtha, flue gas, or other vapors or gases may be introduced to aid in vaporization and act as a lift gas to control residence time.

Coked sorbent is rapidly separated from the hydrocarbon vapors at the exit of the riser by employing the vented riser concept developed by Ashland Oil, Inc., and described in U.S. Pat. Nos. 4,066,533 and 4,070,159 to Myers, et al., which patents are incorporated herein by reference. During the course of the treatment in the riser, the metal and Conradson carbon compounds are deposited on the sorbent. After separation in the vented riser, the coked sorbent is deposited as a dense but fluffed bed at the bottom of the disengagement vessel, transferred to a stripper and then to the regeneraton zone. The coked sorbent is then contacted with an oxygen containing gas to remove the carbonaceous material through combustion to carbon oxides to yield a regenerated sorbent containing less then 0.2 wt % carbon, preferably less than 0.10 wt % carbon. The regenerated sorbent is then recycled to the bottom of the riser where it again joins high metal and Conradson carbon containing feed to repeat the cycle.

At the elevated tempertures encountered in the regeneration zone, the vanadium deposited on the sorbent in the riser is converted to vanadium oxides, in particular, vanadium pentoxide. The melting point of vanadium pentoxide is much lower than the temperatures encountered in the regeneration zone. Thus, it can become a mobile liquid and flow across the sorbent surface, causing pore plugging and particle coalescence. It can also cause sintering of the sorbent material and significant losses of pore volume.

This application describes a new approach to offsetting the adverse effects of vanadium pentoxide by the incorporation of select free metals, their oxides or their salts into the sorbent matrix during manufacture, either by addition to the undried sorbent composition or by impregnation techniques after spray drying or other particle forming techniques, or during reduced crude treatment by introducing these additives at select points in the treatment unit to affect vanadium immobilization through compound, complex, or alloy formation. These metal additives serve to immobilize vanadia by creating complexes, compounds or alloys of vanadia having melting points which are higher than the temperatures encountered in the regeneration zone.

The metal additives for immobilizing vanadia include the following metals, their oxides and salts, and their organo-metallic compounds: Mg, Ca, Sr, Ba, Sc, Y, La, Ti, Zr, Hf, Nb, Ta, Mn, Ni, In, Tl, Bi, Te, the rare earths, and the actinide and lanthanide series of elements. These metal additives based on the metal element content may be used in concentration ranges from about 0.5 to 25 percent, more preferably about 1 to 8 percent by weight of virgin sorbent. If added instead during the treatment process, the metal elements may build up to these concentrations on equilibrium sorbent and be maintained at these levels by sorbent replacement.

The select sorbents of this invention include solids of low catalytic activity, such as spent catalyst, clays, such as bentonite, kaolin, montmorillonite, smectites, and other 2-layered lamellar silicates, mullite, pumice, silica, laterite, and combinations of one or more of these or like materials. The surfce area of these sorbents are preferably below 50 $m^2/g$, have a pore volume of approximately 0.2 cc/g or greater and a micro-activity value as measured by the ASTM Test Method No. D3907-80 of below 20.

BRIEF DESCRIPTION OF THE DRAWINGS

The invention may be further understood by reference to the description of the best mode taken in conjunction with the accompanying drawings in which:

FIG. 5 is a table showing sorbent replacement rates required to hold vanadium at different levels on process sorbent for feeds of varying vanadium content.

FIG. 6 is a table illustrating the amount of titanium additive required for different levels of vanadium in the feed and the cost savings available from operating at the higher vanadium levels permitted by the invention.

BEST MODE FOR CARRYING OUT THE INVENTION

Figure 1:
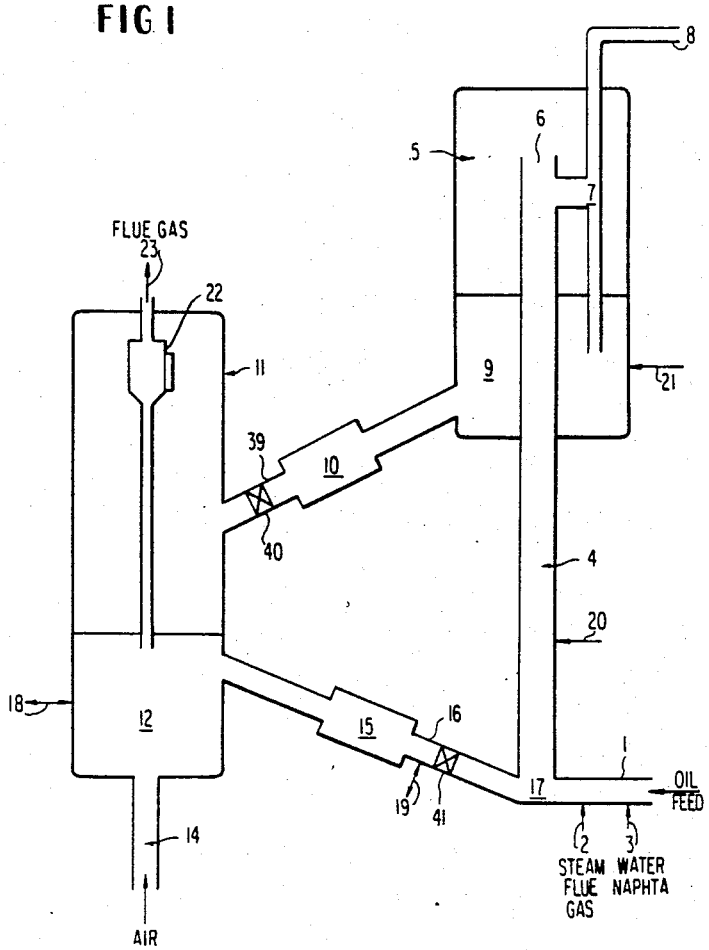
FIG. 1 is a schematic diagram of an apparatus for carrying out the process of the invention.

It is not proposed to define the exact mechanism for the immobilization of vanadia but the metal additives of this invention will form compounds, complexes or alloys with vanadia that have higher melting points than the temperatures encountered in the regeneration zone. The atomic ratio of additive metal to vanadium to be maintained on the catalyst is at least 0.5 or 1.0 depending on the number of additive metal atoms in the oxide of the additive metal, e.g. $TiO_2$ or $In_2O_3$, forming a stable, high melting binary oxide material with vanadium pentoxide ($V_2O_5$). Thus, at the preferred ratio, the melting point of the binary oxide material should be generally well above the operating temperatures of the regenerator. Although, initially, the amount of metal will be considerably above the preferred minimum ratio if it is incorporated in the catalyst prior to use, the ratio of additive metal to vanadium on the catalyst will decrease as vanadium is deposited on the catalyst. Alternatively, the metal additive may be added to the process at a preferred minimum rate equivalent to either 50% or 100% of the metal content of the feed, depending on whether a 0.5 or 1.0 minimum ratio is to be maintained. This latter approach was employed to identify and confirm suitable metal additives which can form binary mixtures with vanadium pentoxide so as to yield a solid material that has a melting point of at least about 1600° F., preferably at least about 1700° F., more preferably 1800° F. or higher, at the preferred ratio. This high melting point product ensures that vanadia will not melt, flow, and cover and/or enter the sorbent pore structure to cause particle coalescence and/or sintering as previously described.

EXAMPLES OF ADDITIVES

The additive metals of this invention include those elements from the Periodic chart of elements shown in Table A. The melting points of Table A are based on a 1:1 mole ratio of the metal additive oxide in its stable valence state under regenerator conditions to vanadium pentoxide.

TABLE A

| | | M.P. of 1/1 Mixture - °F. |
|---|---|---|
| Group IIA | Mg, Ca, Sr, Ba | >1740 |
| Group IIIB | Sc, Y, La | 1800–2100 |
| Group IVB | Ti, Zr, Hf | 1700–2000 |
| Group VB | Nb, Ta | 1800–2000 |
| Group VIIB | Mn, Tc, Re | >1750 |
| Group VIII | Ni, Ru, Rh, Pd, Os, Ir, Pt | >1600 |
| Group IIIA | In, Tl | >1800 |
| Group VA | Bi, As, Sb | >1600 |
| Lanthanide Series | All | >1800 |
| Actinide Series | All | >1800 |

This invention also recognizes that mixtures of these additive metals with vanadia may occur to form high melting ternary, quaternary, or higher component reaction mixtures. Examples of such additional ternary and quaternary compounds are shown in Table B.

TABLE B

| COMPOUND | M.P. °F. |
|---|---|
| $VO—TiO_2—ZrO_2$ | >1800 |
| $Ba_3—V—Ti_2O_9$ | >1800 |
| $BaO—K_2O—TiO_2—V_2O_4$ | >1800 |
| $BaO—Na_2O—TiO_2—V_2O_5$ | >1800 |

Further, in this invention we have covered the lower oxidation states of vanadium as well as vanadium pentoxide. However, in treating a sulfur containing feed and regeneration in the presence of an oxygen containing gas, vanadium will also likely form compounds, such as vanadium sulfides, sulfates, and oxysulfides, which may also form binary, ternary, quaternary or higher component reaction mixtures with the metal additives of this invention.

While not intending to be bound by any one theory or mechanism, it is believed that a reaction of the metal additive with vanadia generally yields a binary reaction product. In the case of manganese acetate reacting with vanadium pentoxide, the compound formed was tentatively identified as $Mn_2V_2O_7$. When titania was reacted with vanadium pentoxide, no true compound could be identified because the reaction is believed to involve the substitution of $Ti^{+4}$ in the crystalline structure by $V^{+4}$. Thus, the disappearance of the titania X-ray pattern and the vanadium pentoxide X-ray pattern was observed, indicating vanadium substitution.

The preferred metal additives are compounds of magnesium, calcium, barium, titanium, zirconium, manganese, indium, lanthanum, or a mixture of the compounds of these metals. Where the additive is introduced directly into the treatment process, that is into the riser, into the regenerator or into any intermediate components, the metal additives are preferably organo-metallic compounds of these metals soluble in the hydrocarbon feed or in a hydrocarbon solvent miscible with the feed. Examples of preferred organo-metallic compounds are tetraisopropyl-titanate, Ti $(C_3H_7O)_4$, available as TYZOR from the DuPont Company; methylcyclopentadienyl manganese tricarbonyl (MMT), Mn $(CO)_3$ $C_6H_7$; zirconium isopropoxide, Zr $(C_3H_7O)_4$; barium acetate, Ba $(C_2H_3O_2)_2$; calcium oxalate, Ca $(C_2O_4)$; magnesium stearate, Mg $(C_{18}H_{35}O_2)_2$; Indium 2,4 pentanedionate - In $(C_5H_7O_2)_3$; Tantalum ethoxide - Ta $(C_2H_5O)_5$; and zirconium 2,4-pentanedionate - Zr $(C_5H_7O_2)_4$. Other preferred process additives include titanium tetrachloride and manganese acetate, both of which are relatively inexpensive. These additives are only a partial example of the various types available and others would include alcoholates, esters, phenolates, naphthenates, carboxylates, dienyl sandwich compounds, and various inorganic compounds soluble in hydrocarbon solvents. The invention therefore is not limited to the examples given. The organo-metallic additives are preferably introduced directly into the hydrocarbon treatment zone, preferably near the bottom of the riser, so that the metal additive will be deposited on the sorbent along with the heavy metals in the feed. When the additive metal of the invention reaches the regenerator, its oxide is formed, either by decomposition of the additive directly to the metal oxide or by decomposition of the additive to the free metal which is then oxidized under the regenerator conditions. This provides an intimate mixture of metal additive and heavy metals and is believed to be one of the most effective means for tying up vanadium pentoxide as soon as it is formed in the regenerator. The metal additive is introduced into the riser by mixing it with the feed in an amount sufficient to give an atomic ratio between the metal in the additive and the vanadium in the feed of at least 0.25, preferably in the range of 0.5 to 3.0, more preferably in the range of 0.75 to 1.5, and most preferably 100 to 200 percent of the preferred minimum ratios previously defined.

If the metal additive is added directly to the sorbent during sorbent manufacture or at some other time before the sorbent is introduced into the treatment system, the metal additives are preferably water soluble inorganic salts of these metals, such as the acetate, halide, nitrate, sulfate, sulfite and/or carbonate. If the metal additive is not added to the sorbent before or during particle formation, then it can be added by impregnation techniques to the dried sorbent particles which are preferably spray dried microspheres. Impregnation after drying may be advantageous in some cases where sites of additive metal are likely to be impaired by sorbent matrix material which might partially cover additive metal sites introduced before spray drying or before some other particle solidification process. Inorganic metal additives may also be introduced into the treatment process along with water containing streams, such as used to cool the regenerator or to lift, fluidize or strip sorbent.

EXAMPLE OF SPRAY DRYING TO PRODUCE SORBENT

One calcined sorbent material which may be preformed for use in the method according to the invention, is wellknown to specialists in the field. It is used as a chemical reaction component with sodium hydroxide for the production of fluidizable zeolite-type cracking catalysts, as described in U.S. Pat. No. 3,647,718 to Haden et al. This sorbent material is a dehydrated kaolin clay. According to analysis, this kaolin clay contains about 51 to 53% (wt %) $SiO_2$, 41 to 45% $Al_2O_3$ and 0 to 1% $H_2O$, the remainder consisting of small amounts of originally present impurities. Although these impurities may include titanium, this titanium is bound up in the clay and is not in a form capable of tying up significant amounts of vanadium. In order to facilitate the spray drying, this powdered dehydrated clay should be dispersed in water in the presence of a deflocculation agent, for example sodium silicate or a condensed phosphate sodium salt, such as tetrasodium pyrophosphate. By employing a deflocculation agent the spray drying can be conducted with higher proportions of solids, which generally leads to a harder product. With deflocculation agents, it is possible to produce suspensions which contain about 55 to 60% solids. These suspensions of high solids content are better than suspensions with a solids content of 40 to 50%, which contain no deflocculation agent.

Several different procedures can be used to mix the ingredients for the production of the suspension. For example, in one procedure the finely divided solids are mixed dry, then water is added, and after that the deflocculation agent is worked in. The components can be processed mechanically, either together or individually, in order to produce suspensions with the desired viscosity properties.

The spray dryers used can have countercurrent or cocurrent or a mixed countercurrent/cocurrent movement of the suspension and the hot air for the production of microspheres. The air can be heated electrically or by other indirect means. Combustion gases, such as those obtained in the air from the combustion of hydrocarbon heating oils, can also be used.

If a cocurrent dryer is used, the air inlet temperature can be as high as 649° C. (1200° F.) and the clay should be charged at a rate sufficient to guarantee an air outlet temperature of about 121° to 316° C. (250 to 600° F.). At these temperatures the free moisture of the suspension is driven away without removing the water of hydration (water of crystallization) from the crude clay component. A dehydration of part or all of the crude clay during the spray drying may be envisioned. The product from the spray dryer can be fractioned in order to obtain microspheres of the desired particle size. The particles used in the present invention have diameters in the range of 10 to 200 microns, preferably about 20 to 150 microns, more preferably about 40 to 80 microns. The calcination can be conducted later during the production period or by introducing the spraydried particles directly into a calcining apparatus.

Although it is advantageous in some cases to calcine the microspheres at temperatures of about 871° to 1149° C. (1600° to 2100° F.) in order to obtain particles of maximum hardness, it is also possible to dehydrate the microspehres by calcining at lower temperatures. Tempertures of about 538° to 871° C. (1000° to 1600° F.) can be used, to transform the clay into a material known as "metakaolin". After calcination, the microspheres should be cooled down and, if necessary, fractionated to obtain the desired particle size range.

| MATERIALS | AMOUNT |
|---|---|
| (A) Tap Water | 11 liters |
| (B) $Na_2SiO_3$ - PQ Corp. 'N' Brand | 8.35 liters |
| (C) Concen. $H_2SO_4$ | 1.15 liters |
| (D) Alum | 0.8 Kg. |
| (E) Clay - Hydrite AF | 12 Kg. |
| (F) Titania - DuPont Anatase | 5 Kg. |
| (G) Sodium Pyrophosphate | 150 gm. |

Ingredients G, E, and F in this order are added while mixing to 8 liters of water at a pH of 2 and ambient conditions to obtain a 70 wt % solids slurry which is held for further processing.

Tap water (A) is added to a homogenizing mixer (Kady Mill) with sulfuric acid (C) and mixed for five minutes. Sodium silicate B is then added continuously over a fifteen minute period ( 600 ml/min.) to the stirred acid solution to provide a silica sol.

The 70 wt % solids slurry from the first step is then added to the stirred Kady Mill and mixed for fifteen minutes. The pH of the solution is maintained at 2.0–2.5 by addition of acid if needed. The temperature during addition, mixing, and acidification is maintained below 120° F. and the viscosity of the solution adjusted to 1000 CPS by the addition of water.

The resulting mixture is immediately atomized, i.e. sprayed, into a heated gaseous atmosphere, such as air and/or steam having an inlet temperature of 400° C., and an outlet temperature of 130° C., using a commercially available spray drier, such as Model V, Production Minor Unit, made by Niro Atomizer, Inc. of Columbia, Md., U.S.A. The resulting microspherical particles are washed with 20 liters of hot water and dried at 350° F. for 3 hours. This yields a sorbent containing 25 wt % titanium as titanium dioxide on a volatile free basis.

It is critical to successful operation of this process that the mixing and subsequent spray drying take place rapidly to prevent premature setting of the gel. In this connection, the silica sol and the solids slurry may be ed separately to a spray drier nozzle and the two streams mixed instantaneously and homogeneously. Such a mixing process is described in U.S. Pat. No. 4,126,579, which is incorporated herein by reference. The air atomizer used should feed the two components into the nozzle at pressures of about 30 to 90 psi and maintain the air in the nozzle at about 50 to 60 psi, preferably about 51–53 psi. As an alternative to premixing with either component, the metal additive may also be fed separately to the nozzle via a separate line operated at pressures of about 30 to 90 psi.

TITANIA IMPREGNATED SORBENT

Seventy-five grams of sorbent (not calcined) is dried at 100° C. under vacuum for two hours. 2.4 ml of DuPont's Tyzor TPT (tetra isopropyl titanate) is dissolved in 75 ml of cyclohexane. Utilizing a Roto-Vap apparatus, the titanium solution is added to the vacuum dried sorbent and allowed to contact with agitation for 30 minutes. Excess solution is then stripped from the impregnated sorbent to yield dried solid particles. The sorbent is then humidified in a dessicator (50% relative humidity) for 24 hours. The sorbent is then regenerated (organic moieties burned off) as a shallow bed in a furnace at 900° F. for 6 hours. This procedure yields a sorbent containing 0.53 wt % Ti on sorbent.

ADDITIVE MIXED WITH SORBENT

As another preferred embodiment of the invention, the metal additive may be incorporated directly into the sorbent material. To an aqueous slurry of the raw sorbent material is mixed the metal additive in an amount to yield approximately 1 to 25 wt % concentration on the finished sorbent. The metal additive can be added in the form of a water soluble compound such as the nitrate, halide, sulfate, carbonate, or the like, and/or as an oxide or hydrous gel, such as titania or zirconia gel.

Other active gelatinous precipates or other gel like materials may also be used. This mixture may be spray dried to yield the finished sorbent as a microspherical particle of 10 to 200 microns in size with the active metal additive deposited within the matrix and/or on the outer surface of the catalyst particle. Since the concentration of vanadium on spent sorbent can be as high as 4 wt % of particle weight, the concentration of additive metal is preferably in the range of 1 to 8 wt % as the metal element. More preferably, there is sufficient metal additive to maintain at least the preferred minimum atomic ratio of additive metal to vanadium at all times.

MOVING BED SORBENT

A hydrosol containing the sorbent materials described in this invention are introduced as drops of hydrosol into a water immiscible liquid wherein the hydrosol sets to spheroidal bead-like particles of hydrogel. The larger size spheres are ordinarily within the range of about 1/64 to about ¼ inch in diameter. The resulting spherical hydrogel beads are dried at 300° F. for 6 hours and calcined for 3 hours at 1300° F. The use of these calcined spherical beads is of particular advantage in a moving bed process.

Representative feedstocks contemplated for use with the invention include whole crude oils; light fractions of crude oils such as light gas oils, heavy gas oils, and vacuum gas oils; and heavy fractions of crude oils such as topped crude, reduced crude, vacuum fractionator bottoms, other fractions containing heavy residua, coal-derived oils, shale oils, waxes, untreated or deasphalted residua, and blends of such fractions with gas oils and the like. Thus, a relatively small amount (5–25%) reduced crude or other heavy hydrocarbon feedstock may be mixed with VGO to provide an FCC feedstock. A high vanadium feed for FCC processing is one having more than 0.1 ppm vanadium, preferably 1.0 to 5.0 ppm. A high vanadium feed for RCC processing is one having more than 1.0 ppm vanadium, preferably more than about 5.0 ppm. In either case, the preferred weight ratio of vanadium to nickel in feed without additive nickel is in the range of from about 1:3 to 5:1, more preferably greater than about 1:1.

The vanadia immobilization sorbent and the metals-Conradson carbon removal process described in this specification are preferably employed to provide a RCC feedstock for the processes and apparatuses for carbo-metallic oil conversion described in co-pending U.S. application Ser. Nos. 94,091; 94,092; 94,216; 94,217; and 94,277; each of said co-pending applications having been filed on Nov. 14, 1979, and being expressly incorporated herein by reference. The sorbent and metals-Conradson carbon removal process of the present invention may also be used in combination with the applicants' co-filed application entitled, "Immobilization of Vanadia Deposited on Catalytic Materials During Carbo-Metallic Oil Conversion", which application is also incorporated herein by reference.

The preferred feeds capable of being cracked by these RCC methods and apparatuses are comprised of 100% or less of 650° F.+material of which at least 5 wt %, preferably at least 10 wt %, does not boil below about 1,025° F. The terms "high molecular weight" and/or "heavy" hydrocarbons refer to those hydrocarbon fractions having a normal boiling point of at least 1,025° F. and include non-boiling hydrocarbons, i.e., those materials which may not boil under any conditions.

A carbo-metallic feed for purposes of this invention is one having a heavy metal content of at least about 4 ppm nickel equivalents, (ppm total metals being converted to nickel equivalents by the formula: Ni Eq.$=Ni+V/4.8+Fe/7.1+Cu/1.23$), a Conradson carbon residue value greater than about 1.0, and a vanadium content of at least 1.0 ppm. The feedstocks for which the invention is particularly useful will have a heavy metal content of at least about 5 ppm of nickel equivalents, a vanadium content of at least 2.0 ppm, and a Conradson residue of at least about 2.0. The greater the heavy metal content and the greater the proportion of vanadium in that heavy metal content, the more advantageous the metal additives and processes of this invention becomes.

A particularly preferred feedstock for treatment by the process of the invention includes a reduced crude comprising 70% or more of a 650° F.+material having a fraction greater than 20% boiling about 1,025° F. at atmospheric pressure, a metals content of greater than 5.5 ppm nickel equivalents of which at least 5 ppm is vanadium, a vanadium to nickel atomic ratio of at least 1.0, and a Conradson carbon residue greater than 4.0. This feed may also have a hydrogen to carbon ratio of less than about 1.8 and coke precursors in an amount sufficient to yield about 4 to 14% coke by weight based on fresh feed.

Sodium vanadates have low melting points and may also flow and cause particle coalescence in the same manner as vanadium pentoxide. Although it is desirable to maintain low sodium levels in the feed in order to minimize coalescence, as well as to avoid sodium vanadates on the sorbent, the metal additives of the present invention are also effective in forming compounds, alloys, or complexes with sodium vanadates so as to prevent these compounds from melting and flowing.

With respect to the tolerance levels of heavy metals on the sorbent itself, such metals may accumulate on the sorbent to levels in the range of from about 3,000 to 70,000 ppm of total metals, preferably 10,000 to 30,000 ppm, of which 5 to 100%, preferably 20 to 80% is vanadium.

The feed may contain nickel in controlled amounts so that the oxides of nickel may help tie up vanadium pentoxide in a high melting complex, compound or alloy. The invention, therefore, contemplates controlling the amounts of nickel in the feed by introducing nickel additives or feedstocks with high nickel to vanadium ratios so that the compounds of this metal, either alone or in combination with other additives, comprise the metal additive of the invention. Similarly, a nickel containing sorbent may also be made by first using virgin sorbent, with or without another metal additive, in a treatment process employing a feedstock with a high nickel to vanadium ratio; and then using the resulting equilibrium sorbent as make-up sorbent in the process of the present invention. In these embodiments, the atomic ratio of nickel to vanadium on the sorbent should be greater than 1.0, preferably at least about 1.5.

The treating process according to the methods of the invention will produce coke in amounts of 1 to 14 percent by weight based on weight of fresh feed. This coke is laid down on the sorbent in amounts in the range of about 0.3 to 3 percent by weight of sorbent, depending upon the sorbent to oil ratio (weight of sorbent to weight of feedstock) in the riser. The severity of the process should be sufficiently low so that conversion of the feed to gasoline and lighter products is below 20 volume percent, preferably below 10 volume percent. Even at these low levels of severity, the treatment process is effective to reduce Conradson carbon values by at least 20 percent, preferably in the range of 40 to 70 percent, and heavy metals content by at least 50 percent, preferably in the range of 75 to 90 percent.

The feed, with or without pretreatment, is introduced as shown in FIG. 1 into the bottom of the riser along with a suspension of hot sorbent prepared in accordance with this invention. Steam, naphtha, water, flue gas and/or some other diluent is preferably introduced into the riser along with feed. These diluents may be from a fresh source or may be recycled from a process stream in the refinery. Where recycle diluent streams are used, they may contain hydrogen sulfide and other sulfur compounds which may help passivate adverse catalytic activity by heavy metals accumulating on the catalyst. It is to be understood that water diluents may be introduced either as a liquid or as steam. Water is added primarily as a source of vapor for dispersing the feed and accelerating the feed and sorbent to achieve the vapor velocity and residence time desired. Other diluents as such need not be added but where used, the total amount of diluent specified includes the amount of water used. Extra diluent would further increase the vapor velocity and further lower the feed partial pressure in the riser.

As the feed travels up the riser, it forms basically four products known in the industry as dry gas, wet gas, naphtha, and RCC or FCC feedstock. At the upper end of the riser, the sorbent particles are ballistically separated from product vapors as previously described. The sorbent which then contains the coke formed in the riser is sent to the regenerator to burn off the coke and the separated product vapors are sent to a fractionator for further separation and treatment to provide the four basic products indicated. The preferred conditions for contacting feed and sorbent in the riser are summarized in Table C, in which the abbreviations used have the following meanings: "Temp." for temperature, "Dil." for diluent, "pp" for partial pressure, "wgt" for weight, "V" for vapor, "Res." for residence, "S/O" for sorbent to oil ratios, "sorb." for sorbent, "bbl" for barrel, "MAT" for microactivity by the MAT test using a standard Davison feedstock, "Vel." for velocity, "cge" for charge, "d" for density and "Reg." for regenerated.

TABLE C

| Sorbent Riser Conditions | | |
|---|---|---|
| Parameter | Board Operating Range | Preferred Range |
| Feed Temp. - | 400–800° F. | 400–650° F. |
| Steam Temp. - | 20–500° F. | 300–400° F. |
| Reg. Sorbent Temp. - | 900–1500° F. | 1150–1400° F. |
| Riser Exit Temp. - | 800–1400° F. | 900–1100° F. |
| Pressure - | 0–100 psia | 10–50 psia |
| Water/Feed - | 0.01–0.30 | 0.04–0.15 |
| Dil. pp/Feed pp - | 0.25–3.0 | 1.0–2.5 |
| Dil. wgt/Feed wgt - | ≦0.4 | 0.1–0.3 |
| V. Res. Time - | 0.1–5 | 0.5–3 sec. |
| S/O, wgt. - | 3–18 | 5–12 |
| Lbs. Sorb./bbl Feed | 0.1–4.0 | 0.2–2.0 |
| Inlet Sorb. MAT - | <25 vol. % | <20 |
| Outlet Sorb. MAT - | <20 vol. % | <10 |
| V. Vel. - | 25–90 ft./sec. | 30–60 |
| V. Vel./Sorb. Vel. | ≧1.0 | 1.2–2.0 |
| Dil. Cge. Vel - | 5–90 ft./sec. | 10–50 |
| Oil Cge. Vel. - | 1–50 ft./sec. | 5–50 |
| Inlet Sorb. d - | 1–9 lbs./ft.$^3$ | 2–6 |
| Outlet Sorb. d - | 1–6 lbs./ft.$^3$ | 1–3 |

In treating carbo-metallic feedstocks in accordance with the present invention, the regenerating gas may be any gas which can provide oxygen to convert carbon to carbon oxides. Air is highly suitable for this purpose in view of its ready availablity. The amount of air required per pound of coke for combustion depends upon the desired carbon dioxide to carbon monoxide ratio in the effluent gases and upon the amount of other combustible materials present in the coke, such as hydrogen, sulfur, nitrogen and other elements capable of forming gaseous oxides at regenerator conditions.

The regenerator is operated at temperatures in the range of about 900° to 1,500° F., preferably 1,150° to 1,400° F., to achieve adequate combustion while keeping sorbent temperatures below those at which significant sorbent degradation can occur. In order to control these temperatures, it is necessary to control the rate of burning which, in turn, can be controlled at least in part by the relative amounts of oxidizing gas and carbon introduced into the regeneration zone per unit time. With reference to FIG. 1, the rate of introducing carbon into the regenerator may be controlled by regulating the rate of flow of coked sorbent through valve 40 in conduit 39, the rate of removal of regenerated sorbent by regulating valve 41 in conduit 16, and the rate of introducing oxidizing gas by the speed of operation of blowers (not shown) supplying air to the conduit 14. These parameters may be regulated such the the ratio of carbon dioxide to carbon monoxide in the effluent gases is equal to or less than about 4.0, preferably about 1.5 or less. In addition, water, either as liquid or steam, may be added to the regenerator to help control temperatures and to influence the carbon dioxide to carbon monoxide ratio.

The regenerator combustion reaction is carried out so that the amount of carbon remaining on regenerated sorbent is less than about 0.25, preferably less than about 0.20 percent on a substantially moisture-free weight basis. The residual carbon level is ascertained by conventional techniques which include drying the sorbent at 1,100° F. for about four hours before actually measuring the carbon content so that the carbon level obtained is on a moisture-free basis.

When the metal additive is introduced as an aqueous or hydrocarbon solution or as a volatile compound during the processing cycle, it may be added at any point of sorbent travel in the processing apparatus. With reference to FIG. 1, this would include, but not be limited to, addition of the metal additive solution at the riser wye 17, along the riser length 4, to the dense bed 9 in the reactor vessel 5, to the strippers 10 and 15, to regenerator air inlet 14, to regenerator dense bed 12, and/or to regenerated sorbent standpipe 16.

The sorbent of this invention with or without the metal additive is charged to a treatment unit of the type outlined in FIG. 1 or a Reduced Crude Conversion (RCC) unit of the type disclosed in Ashland's said RCC applications. Sorbent particle circulation and operating parameters are brought up to process conditions by methods well-known to those skilled in the art. The equilibrium sorbent at a temperature of 1,150°–1,400° F. contacts the oil feed at riser wye 17. The feed can contain steam and/or flue gas injected at point 2 or water and/or naphtha injected at point 3 to aid in feed vaporization, sorbent fluidization and controlling contact time in riser 4. The sorbent and vaporous hydrocarbons travel up riser 4 at a contact time of 0.1–5 seconds, preferably 0.5–3 seconds. The sorbent and vaporous hydrocarbons are separated in vented riser outlet 6 at a final reaction temperature of 900°–1100° F. The vaporous hydrocarbons are transferred to a multistage cyclone 7 where any entrained sorbent fines are separated and the hydrocarbon vapors are sent to a fractionator (not shown) via tranfer line 8. The coked sorbert is the transferred to stripper 10 for removal of entrained hydrocarbon vapors and then to regenerator vessel 11 to form a dense fluidized bed 12. An oxygen containing gas such as air is admitted to the bottom of dense bed 12 in vessel 11 to combust the coke to carbon oxides. The resulting flue gas is processed through cyclones 22 and exits from regenerator vessel 11 via line 23. The regenerated sorbent is transferred to stripper 15 to remove any entrained combustion gases and then transferred to riser wye 17 via line 16 to repeat the cycle.

At such time that the metal level on the sorbent becomes intolerably high such that sorbent effectiveness and/or selectivity declines, additional sorbent can be added and deactivated sorbent withdrawn at addition-withdrawal point 18 into the dense bed 12 of regenerator 11 and/or at addition-withdrawal point 19 into regenerated sorbent standpipe 16. Addition-withdrawal points 18 and 19 can be utilized to add virgin sorbents containing one or more metal additives of the invention. In the case of a virgin sorbent without additive, the metal additive as an aqueous solution or as an organometallic compound in aqueous or hydrocarbon solvents can be added at points 18 and 19, as well as at addition points 2 and 3 on feed line 1, addition point 20 in riser 4 and addition point 21 near the bottom of vessel 5. The addition of the metal additive is not limited to these locations, but can be introduced at any point in the oil/sorbent processing cycle.

EXAMPLES OF ADDITIVE ADDITION TO PROCESS

As an example of additive addition to such commercial treating processes, TPT was diluted with heavy gas oil (HGO) to form a solution of 1 part TPT to 1 part HGO. This solution was added to the riser feed line in an amount sufficient to yield 1 part titanium by weight to 1 part vanadium in the feed. The feed was a reduced crude processed at 600,000 lb. per day with a vanadium content of 200 ppm. Based on the vanadium content and the molecular weight of the TPT, this equated to adding 420 lbs. of TPT per day to 600,000 lbs. of reduced crude feed per day.

Figure 2:
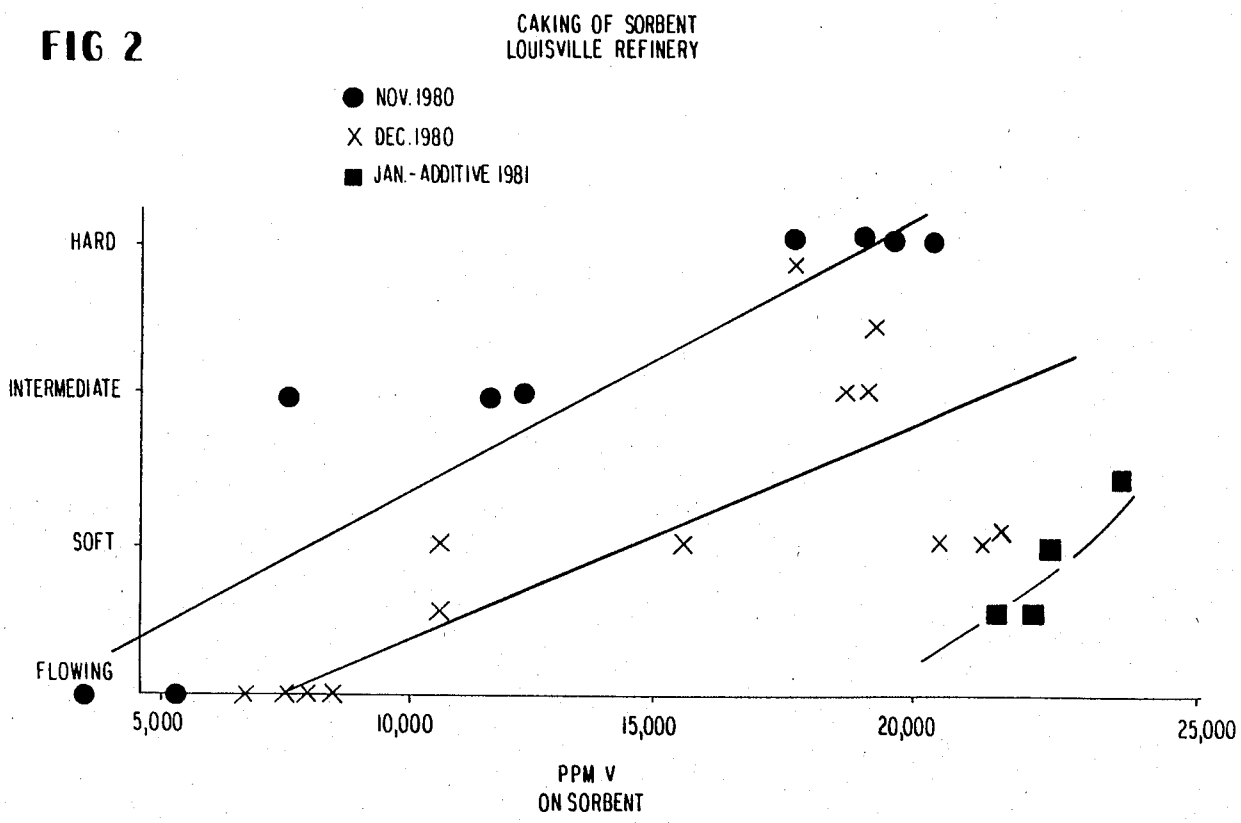
FIG. 2 is a graph showing the change in sorbent properties with increasing amounts of vanadium on the sorbent and the effect of a metal additive on sorbent properties.

The results of adding TPT to the unit are shown in FIG. 2. Sorbent samples at varying vanadium levels were taken during two process periods (dots and X's) when the additive of the invention was not utilized, and similar samples were taken during additive addition (boxes). These samples were then subjected to the clumping test described below to determine the flow characteristics of vanadia containing sorbent particles. The vanadia containing sorbent samples were placed in individual ceramic crucibles, dried and calcined at 1,400° F. in air for two hours. The crucibles are withdrawn and cooled to room temperature. Vanadia, while liquid at operating temperature (1,400° F.), will flow across the sorbent surface and cause sorbent particle coalescence when cooled down below the solidification point. The degree of coalescence shown in FIG. 2 is a visual and mechanical estimation of particle fusion, namely, flowing—no change in flow characteristics between virgin sorbent and used sorbent; soft—substantially all of used sorbent free flowing with a small amount of clumps easily crushed to free flowing sorbent; intermediate—free flowing sorbent containing both free flowing particles and fused masses in approximately a 1:1 ratio; and hard—substantially all of the sorbent particles fused into a hard mass with very few free flowing particles.

The sorbent of FIG. 2 was used in the treatment of a reduced crude to lower vanadium and Conradson carbon values. In two extended runs of approximately 30 days (dots and X's), the sorbent particles began to show coalescence properties at vanadium levels of 10,000 ppm, and by 20,000 ppm had showed coalescence into a hard mass (loss of fluidization properties). In the third period (boxes), one of the additives of the invention, namely, TPT, was added during the processing cycle as the hydrocarbon solution discussed above. This additive permitted operation in the 20,000 to 25,000 ppm level of vanadium without any loss in fluidization through particle coalescence.

Another example of commercial application of the metal additive of this invention was the use of methylcyclopentadienyl manganese tricarbonyl (MMT). Two drums of this material were added over a two hour period to partially immobilize the vanadium on the sorbent. Each drum weighed 410 lbs. and contained 25 wt % MMT in a hydrocarbon solvent. Based on a manganese concentration of 28.3 wgt % Mn in MMT and a circulating sorbent inventory of 42 tons, approximately 700 ppm Mn was deposited on the sorbent. The MMT additions also improved the circulating efficiency of the sorbent.

Figure 3:
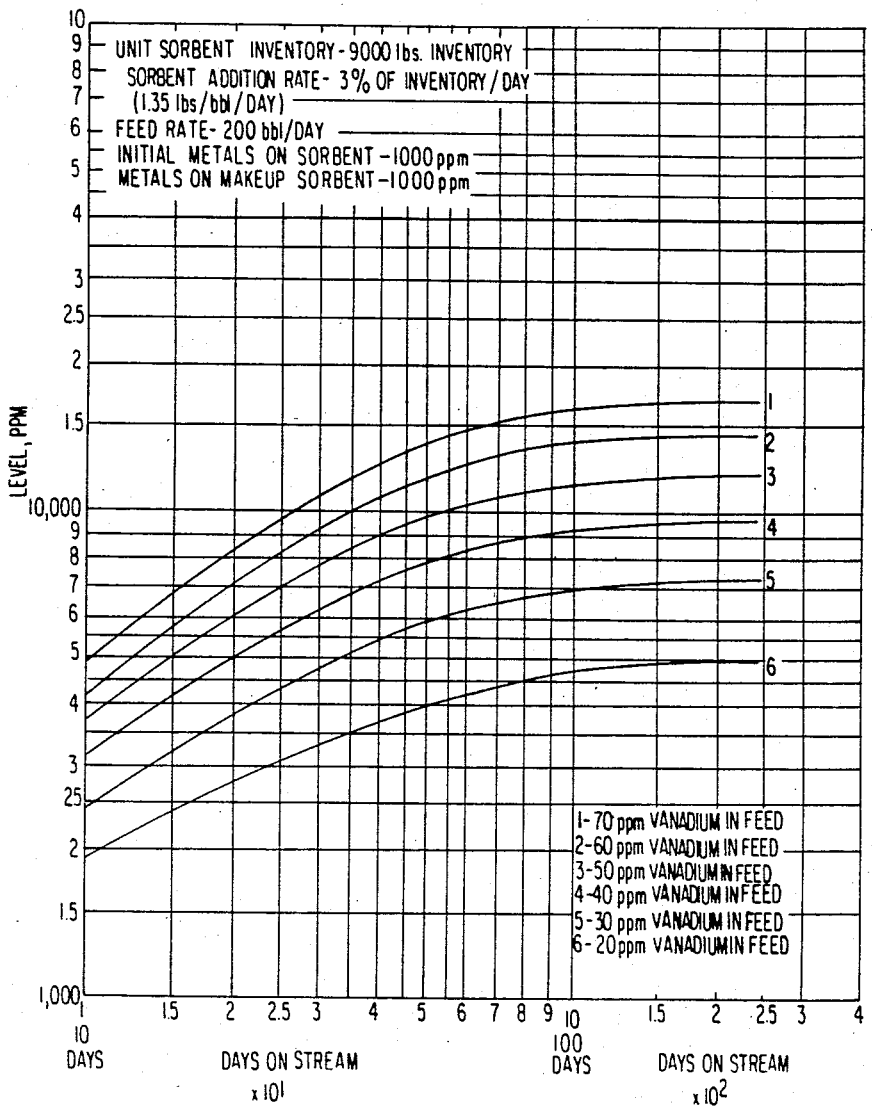
FIG. 3 is a graph showing the time required to build up vanadium on a sorbent at varying vanadium levels in feed and a sorbent addition rate of 3% of inventory.
Figure 4:
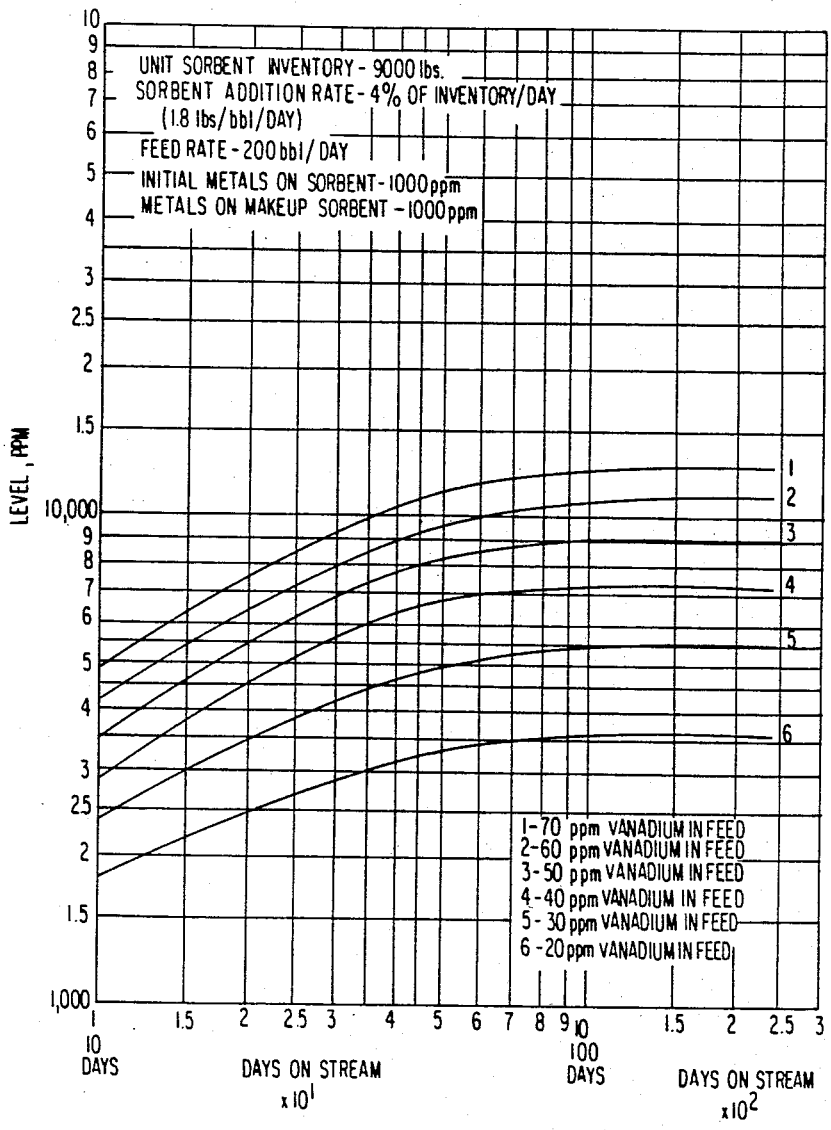
FIG. 4 is a graph showing the time required to build up vanadium on a sorbent at varying vanadium levels in feed and a sorbent addition rate of 4% of inventory.

In a FCC or RCC unit, the rate of metals buildup on the circulating sorbent is a function of metals in the feed, the sorbent circulating inventory, the sorbent addition and withdrawal rates (equal), and the sorbent to oil ratio. FIGS. 3 and 4 give the rate of metal buildup on a circulating sorbent at constant inventory, constant sorbent addition and withdrawal rate and varying metals content in the feed. These figures show that for feed metals levels of 20–70 ppm, total metal levels on the sorbent equilibrate after about 90–150 days. Thereafter, the metals level on sorbent remains constant with time. By utilizing these figures, or similar figures that can be developed for higher metals levels, higher addition rates and higher circulating inventories, the required concentrations of the metal additives of this invention on the sorbent can be calculated so as to yield the preferred minimum atomic ratio of metal additive to vanadium.

For example, in FIG. 3, the unit has 9,000 lbs. of sorbent inventory, a sorbent addition rate of 1.35 lb./bbl. of feed per day, and a feed rate is 200 lb./day. Assuming the metals content is all vanadium, Curve 1 in FIG. 3 would be utilized to show that after 150 days of continuous operation with 70 ppm vanadium in the feed, the vanadium level on the catalyst would equilibrate at about 17,000 ppm and then remain constant with time. Thus, in making a sorbent containing a titania additive according to this invention, the sorbent would be prepared such that it would contain at least 8,500 ppm titanium to ensure at least a 0.5 atomic ratio of titanium to vanadium was maintained at equilibrium conditions. Similar calculations can be performed for lower and higher equilibrium vanadium values using the other curves or multiples of those curves (120 ppm vanadium on sorbent would equilibrate at about 30,000 ppm under the conditions of FIG. 3).

In the treatment of feeds of varying vanadium content, the rate of vanadium buildup on the sorbent and the equilibrium or steady state of vanadium on the sorbent is a function of vanadium content of the feed and especially the sorbent addition and withdrawal rates which are equal at equilibrium conditions. FIG. 5 presents a typical case for a 40,000 bbl/day unit in which the vanadium content of the feed is varied from 1 ppm (treatment of a FCC feed comprised of VGO and 5 to 20 percent of a heavy hydrocarbon fraction) up to 25 to 400 ppm (treatment of a reduced crude for RCC operations). In order to maintain various levels of vanadium on the sorbent at the equilibrium state after long term operation (50 to 150 days), the sorbent addition rate can be varied to yield equilibrated vanadium values of from 5,000 to 30,000 ppm. As explained elsewhere, vanadium, as vanadium pentoxide and/or sodium vanadate on the sorbent, undergoes melting at regenerator temperatures and flows across the sorbent surface, causing particle fusion and coalescence.

For example, at 1,000 ppm vanadium, this phenomena begins to be observed and by 10,000 ppm vanadium particle coalescence becomes a major factor in unit operation. By applying the additive of this invention, one can now operate in the upper ranges of vanadium levels (20,000 to 30,000 ppm) without vanadium deposition causing particle coalescence or excessive sintering of the sorbent structure.

FIG. 6 presents the economic advantage of introducing the additive of this invention into the riser as an aqueous or hydrocarbon solution. The table in FIG. 6 demonstrates the economic differential (savings in $/day) that can be realized by utilizing the additives of this invention and operating at the 30,000 ppm level versus the 10,000 ppm level of vanadium on sorbent.

As shown in FIG. 6, treatment of a feedstock having 1 ppm vanadium for FCC operations would show a savings of at least $28/day with TPT as the additive and $168/day with titanium tetrachloride as the additive. In comparison, treatment of a heavy hydrocarbon oil containing 25 to 100 ppm vanadium for RCC operations would show savings of at least $500 to 2,000/day with TPT as the additive and $4,000 to 22,400/day with titanium tetrachloride as the additive.

The regenerator vessel as illustrated in FIG. 1 is a simple one zone-dense bed type. The regenerator section is not limited to this example but can consist of two or more zones in stacked or side by side relation and with internal and/or external circulation transfer lines from zone to zone. Such multistage regenerators are described in more detail in Ashland's above RCC applications.

Having thus described above the observed detrimental effects of vanadium, the sorbent, and the metal additives and processes of this invention, the following tests illustrate the effects of vanadia flow.

The determination that vanadia deposited on a sorbent would flow and cause coalescence between sorbent particles at regenerator temperatures, and the selection of those elements and their salts which would prevent this process were studied by three methods, namely: the clumping or lump formation technique, vanadia diffusion from or compound formation with a metal additive in an alumina-ceramic crucible, and through spectroscopic studies and differential thermal analyses of vanadia metal additive mixtures.

CLUMPING TEST

A clay, spray dried to yield microspherical particles in the 20 to 150 micron size, had vanadia deposited upon it in varying concentrations. Clay free of vanadia and clay containing varying vanadia concentrations were placed in individual ceramic crucibles and calcined at 1,400° F. in air for two hours. At the end of this time period, the crucibles were withdrawn from the muffle furnace and cooled to room temperatue. The surface texture and flow characteristics of these samples were noted and the results are reported in Table X.

TABLE X

| $V_2O_5$ Concentration-ppm | Surface Texture | Flow Characteristics |
|---|---|---|
| 0 | Free | Free flowing |
| 1,000–5,000 | Surface Clumped | Broke crust for free flowing |
| 5,000–20,000 | Surface Clumped | Total clumping no flow |

As shown in Table X, the clay free of vanadia does not form any crust or clumps or fused particles at temperatures encountered in the regenerator section of the process described in this invention. At vanadia concentrations of 1,000–5,000 ppm, clumping was observed but the crusts binding particles could be readily broken into free flowing, crusty particles. At vanadia concentrations above 5,000 ppm, the clay begins to clump and bind badly and does not flow at all even with moderate impact. While liquid at operating temperature manifestation of this phenomenum is demonstrated by the finding that when these coalesced particles are cooled down below their solidification point in a crucible, or in an operating unit cooled down in order to facilitate entrance to the unit for cleaning out plugged diplegs and other repairs, a solid mass of sorbent is formed which must be forcibly removed. This phenomena makes turnaround lengthy and complex for an operating unit as this material must be chipped out.

CRUCIBLE DIFFUSION TEST

An extension of the clumping test is the use of a ceramic-alumina crucible to determine whether vanadia reacts with a given metal additive. If vanadia does not react with the metal additive or only a small amount of compound formation occurs, then the vanadia diffuses through and over the porous alumina walls and deposits as a yellowish to orange deposit on the outside wall of the crucible. On the other hand, when compound formation occurs, there are little or no vanadia deposits formed on the outside of the crucible wall. Two series of tests were performed. In the first series shown in Table Y, a 1:1 mixture by weight of vanadia pentoxide and the metal additive was placed in the crucible and heated to 1500° F. in air for 12 hours. Compound formation or vanadia diffusion was as noted in Table Y.

TABLE Y

| 1 Part $V_2O_5$ + 1 Part Metal Additive 1500° F. - Air - 12 Hours | | |
|---|---|---|
| Metal Additive | Diffusion of Vanadium | Compound Formation |
| Titania | No | Yes |
| Manganese Acetate | No | Yes |
| Lanthanum Oxide | No | Yes |
| Alumina | Yes | No |
| Barium Acetate | No | Yes |
| Copper Oxide | Yes | Partial |

In the second series of tests, a vanadia containing material was tested in a similar manner. A one to one ratio by weight of vanadium pentoxide and the metal additive were heated to 1,500° F. in air for 12 hours. The results are shown in Table Z. The material reported in Table Z as containing 24,000 ppm vanadia on clay with no metal additive was fired at 1,500° F. and then studied in a scanning electron microscope (SEM). The fused particles initially gave a picture of fused particles. However, as the material was continuously bombarded, the fused particles separated due to the heat generated by the bombarding electrons. One was able to observe the melting and flowing of vanadia as the initial single fused particles separated into two or more distinct microspherical particles.

TABLE Z

| 1 Part $V_2O_5$ - Catalyst + 1 Part Metal Additive 1500° F. - Air - 12 Hours | | |
|---|---|---|
| Vanadia Concentration, ppm | Metal Additive | Particle Formation |
| 24,000 | None | Yes |
| 24,000 | Calcium Oxide | No |
| 24,000 | Magnesium Oxide | No |
| 24,000 | Manganese Oxide | No |

The study of the capability of certain elements to immobilize vanadium pentoxide was extended by use of DuPont differential thermal analyses (DTA), X-ray diffraction (XRD) and scanning electron microscope (SEM) instruments. The metal additives studied on the DTA showed that titania, barium oxide, calcium oxide, the lanthanide series, magnesium oxide and indium oxide all were excellent additives for the formation of high melting metal vanadates, with melting points of 1800° F. or higher. Copper gave intermediate results with compounds melting at approximately 1,500° F. Poor results were obtained with materials such as lead oxide, molybdena, tin oxide, chromia, zinc oxide, cobalt oxide, cadimium oxide and some of the rare earths.

INDUSTRIAL APPLICABILITY

The invention is useful in the treatment of both FCC and RCC feeds as described above. The present invention is particularly useful in the treatment of high boiling carbometallic feedstock of extremely high metals-Conradson carbon values to provide products of lowered metals-Conradson carbon values suitable for use as feedstocks for FCC and/or RCC units. Examples of these oils are reduced crudes and other crude oils or crude oil fractions containing metals and/or residua as above defined.

Although the treating process is preferably conducted in a riser reactor of the vented type, other types of risers and other types of reactors with either upward or downward flow may be employed. Thus, the treating operation may be conducted with a moving bed of sorbent which moves in countercurrent relation to liquid (unvaporized) feedstock under suitable contact conditions of pressure, temperature and weight hourly space velocity. The process conditions, sorbent and feed flows and schematic flow of a moving bed operation are described in the literature, such as those disclosed, for example, in articles entitled "T.C. Reforming", Pet. Engr., April (1954); and "Hyperforming", Pet. Engr., April (1954); which articles are incorporated herein by reference.

What is claimed is:

1. A sorbent material wherein the composition of said sorbent comprises kaolin clay, a titania gel in an amount in the range of about 1 to about 8 weight percent of sorbent, and a metal additive sufficient to immobilize vanadium compounds in the presence of an oxygen containing gas at sorbent regeneration temperatures.

2. A sorbent wherein the composition of said sorbent comprises a kaolin clay, an alumina gel in an amount in the range of about 1 to about 8 weight percent, and a metal additive in an amount sufficient to immobilize vanadium compounds in the presence of an oxygen containing gas at sorbent regeneration temperatures.

3. A composition of matter for use as a sorbent comprising kaolin clay, a zirconia gel in an amount of the range of about 1 to about 8 weight percent, and a metal additive in an amount sufficient to immobilize vanadium compounds in the presence of an oxygen containing gas at sorbent regeneration temperature.

4. A composition of matter for use as a sorbent comprised of microspherical particles each containing clay, a titania gel in an amount in the range of about 1 to about 8 weight percent, and a metal additive in an amount sufficient to immobilize vanadium compounds in the presence of an oxygen containing gas at sorbent regeneration temperature.

5. A sorbent comprised of microspherical particles each containing a metal additive in an amount sufficient to immobilize vanadium compounds in the presence of an oxygen containing gas at sorbent regeneration temperature, microspherical clay, and an alumina gel in an amount in the range of about 1 to about 8 weight percent.

6. A sorbent comprised of microspherical particles each containing a metal additive, in an amount sufficient to immobilize vanadium compounds in the presence of an oxygen containing gas at sorbent regeneration temperature, kaolin clay, a titania gel or a zirconia gel or a combination of titania gel and zirconia gel with an alumina gel, said gel material comprising about 1 to about 8 weight percent of said sorbent.

7. A composition of claim 1 wherein said sorbent comprises a clay and has a surface area below 50 $m^2/g$ and a pore volume of about 0.2 cc/g or greater.

8. A composition of claim 2 wherein said sorbent comprieses a clay and has a surface area below 50 $m^2/g$ and a pore volume of about 0.2 cc/g or greater.

9. A composition of claim 3 wherein said sorbent comprises a clay and has a surface area below 50 $m^2/g$ and a pore volume of about 0.2 cc/g or greater.

10. A composition of claim 4, 5 and 6 wherein said sorbent comprises a clay and has a surface area below 50 $m^2/g$ and a pore volume of about 0.2 cc/g or greater.

11. A composition of claims 1, 2, 3, 4, 5 or 6 wherein said sorbent is in spherical form and ranges in size from 10–200 microns for use in a riser fluidized transfer zone.

12. A composition of claims 1, 2, 3, 4, 5 or 6 wherein said sorbent is in spherical form and ranges in size from greater than 200 microns to $\frac{1}{4}$ inch for use in a moving bed treatment zone.

13. A composition of claims 1, 2, 3, 4, 5 or 6 wherein said sorbent is prepared from materials selected from the group consisting of bentonite, kaolin, montmorillonites, smectites, 2-layered lamellar silicates, mullite, pumice, silica, laterite or pillared inter-layered clays.

14. A composition of claims 1, 2, 3, 4, 5 or 6 wherein said metal additive is a water soluble inorganic metal salt or a hydrocarbon soluble organo-metallic compound.

15. A composition of claims 1, 2, 3, 4, 5 or 6 wherein said metal additive to immobilize vanadium compounds comprises Mg, Ca, Sr, Ba, Sc, Y, La, Ti, Zr, Hf, Nb, Ta, Mn, Mi, In, Tl, Bi, Te, or an element in the lanthanide or actinide series, or an combination of two or more of said elements.

16. A composition of claims 1, 2, 3, 4, 5 or 6 wherein said metal additive can react with vanadium compounds to form binary metal vanadates or mixtures of said vanadates or to form ternary or quaternary compounds, complexes, or alloys.

17. A composition of claims 1, 2, 3, 4, 5 or 6 wherein said metal additive is present in said sorbent in an amount in the range of about 1 to about 20 weight percent.

18. A composition of claims 1, 2, 3, 4, 5 or 6 wherein said metal additive is present in said sorbent in an amount in the range of about 1 to about 8 percent of said sorbent.

19. A composition of claims 1, 2, 3, 4, 5 or 6 wherein said vanadium compounds deposited on said sodium include vanadium oxides, sulfides, sulfites, sulfates, or oxysulfates.

20. A composition of claims 1, 2, 3, 4, 5 or 6 wherein said metal additive is added to an aqueous slurry of the ingredients comprising said sorbent and said aqueous slurry containing said metal additive is spray dried.

21. A composition of claims 1, 2, 3, 4, 5 or 6 wherein said metal additive is added to a spray dried sorbent by impregnation techniques.

22. A composition of claims 1, 2, 3, 4, 5 or 6 wherein said metal additive is introduced into said sorbent by adding an aqueous solution of a metal salt or a hydrocarbon solution of an organo-metallic composition at any point in the processing cycle wherein said sorbent is used.

23. A composition of claims 1, 2, 3, 4, 5 or 6 wherein the concentration of vanadium deposited on said sorbent ranges from about 0.05 to about 5 weight percent of said sorbent based on the weight of said sorbent.

24. A composition of claims 1, 2, 3, 4, 5 or 6 wherein said metal additive is a water soluble inorganic metal salt comprising a halide, nitrate, sulfite, sulfate, or carbonate or a combination of two or more of said salts.

25. A composition of claims 1, 2, 3, 4, 5 or 6 wherein said metal additive is a hydrocarbon soluble metal compound comprised of an alcoholate, ester, phenolate, naphthenate, carboxylate, or dienyl sandwich compound or a combination of two or more of said compounds.

26. A composition of claims 1, 2, 3, 4, 5 or 6 wherein said metal additive is tetraisopropyl titanate.

27. A composition of claims 1, 2, 3, 4, 5 or 6 wherein said metal additive is titanium tetrachloride.

28. A composition of claims 1, 2, 3, 4, 5 or 6 wherein said metal additive is methylcyclopentadienyl manganese tricarbonyl.

29. A composition of claim 1, 2, 3, 4, 5 or 6 wherein said metal additive is zirconia acetate.

* * * * *